US006972359B2

(12) United States Patent
Overs

(10) Patent No.: US 6,972,359 B2
(45) Date of Patent: Dec. 6, 2005

(54) GRAND PIANO ACTION

(76) Inventor: Ronald Ernest Overs, 37 Hospital Rd., Concord West, NSW 2138 (AU)

( * ) Notice: Subject to any disclaimer, the term of this patent is extended or adjusted under 35 U.S.C. 154(b) by 293 days.

(21) Appl. No.: 10/221,510

(22) PCT Filed: Mar. 13, 2001

(86) PCT No.: PCT/AU01/00271

§ 371 (c)(1),
(2), (4) Date: Jan. 13, 2003

(87) PCT Pub. No.: WO01/69586

PCT Pub. Date: Sep. 20, 2001

(65) Prior Publication Data

US 2003/0192420 A1 Oct. 16, 2003

(30) Foreign Application Priority Data

Mar. 14, 2000 (AU) ..... PQ6216

(51) Int. Cl.[7] ..... G10F 1/06
(52) U.S. Cl. ..... 84/216
(58) Field of Search ..... 84/216–221, 239–244, 84/247–253

(56) References Cited

U.S. PATENT DOCUMENTS 1,900,488 A * 3/1933 Dasenbrook ..... 84/239
1,992,939 A * 3/1935 Dasenbrook ..... 84/239
2,172,253 A 9/1939 Morse et al.
3,516,325 A 6/1970 Harada et al.

FOREIGN PATENT DOCUMENTS

GB 2024489 1/1980

* cited by examiner

*Primary Examiner*—Kimberly Lockett

(57) ABSTRACT

A piano action (10) includes a wippen (14) having a wippen body (24). The wippen body (24) is pivotally mountable on a first rail (20) of a piano. A repetition lever (38) is pivotally mounted on the wippen body (24). A jack (46) is also pivotally mounted on the wippen body (24). A repetition lever spring (48) is interposed between the repetition lever (38) and the wippen body (24) and is pivotally mounted to the repetition lever (38). The repetition lever spring (48) has a first limb (54) which acts on the jack (46) for restoring the jack (46) to its rest position and a second limb (52) which acts on the repetition lever (38) for restoring the repetition lever (38) to its rest position. The second limb (52) is shorter than the first limb (54) such that a free end of the second limb (52) is out of engagement with the repetition lever (38) and is shaped and dimensioned to move together with the repetition lever (38). The first limb (54), when the wippen (14) is in its rest position, in use is substantially rectilinear along its length.

43 Claims, 4 Drawing Sheets

GRAND PIANO ACTION

FIELD OF THE INVENTION

This invention relates to a piano action. More particularly, the invention relates to a grand piano action and to components thereof.

BACKGROUND TO THE INVENTION

To improve playing quality of a piano and to increase the longevity of a piano action, it is important to reduce energy lost due to friction (hereinafter referred to as "frictional losses") as much as possible. In so doing, wear on the various parts is also reduced, noise is reduced and the piano action is improved.

In this specification, for ease of explanation, the piano action will be described as including the wippen, the jack, the hammer and its shank and the lett-off button, ie. the piano action stack.

SUMMARY OF THE INVENTION

According to a first aspect of the invention there is provided a piano action which includes a wippen having a wippen body, the wippen body being pivotally mountable via a first end of the wippen body on a first rail of a piano;

a repetition lever pivotally mounted on the wippen body;

a jack pivotally mounted on the wippen body; and a repetition lever spring interposed between the repetition lever and the wippen body and pivotally mounted to the repetition lever, the repetition lever spring having a first limb which acts on the jack for restoring the jack to its rest position and a second limb which acts on the repetition lever for restoring the repetition lever to its rest position, the second limb being shorter than the first limb such that a free end of the second limb is out of engagement with the repetition lever and being shaped and dimensioned to move together with the repetition lever, and the first limb, when the wippen is in its rest position, in use, being substantially rectilinear along its length.

By "rectilinear" is meant that the first limb is substantially straight and continuous without having kinks, coils, or the like therein.

According to a second aspect of the invention there is provided a piano action which includes a jack having a jack body which is pivotally mountable relative to a wippen body via a pivot point;

a jack tender extending at an angle relative to the jack body; and a radiussed portion at a free end of the jack tender, the radiussed portion having a radius of at least 10 mm.

According to a third aspect of the invention, there is provided a piano action which includes a hammer shank assembly including a hammer shank;

a hammer mounted proximate one end of the shank;

a pivot point arranged proximate an opposed end of the shank which pivotally mounts the shank on a hammer flange, the hammer flange being mountable on a rail of the piano; and a receiving means defined in the hammer flange, on a hammer side of the pivot point and adjacent the pivot point, for receiving all adjustment means.

The wippen may include a wippen flange for mounting the wippen relative to the first rail. The wippen body may include a first pivot point for pivotally mounting it to the wippen flange. A boss may be arranged on the wippen body, the boss defining a second pivot point on which the repetition lever is pivotally mounted with the pivot point between the jack and the wippen body being a third pivot point. The pivot point mounting the hammer shank to the hammer flange may be a fourth pivot point.

The arrangement of the pivot points may be such that the first pivot point and the third pivot point are aligned along a line.

In a first embodiment of the invention, a crown of the radiussed free end of the jack tender of the jack may lie substantially on the line when the piano action is in its rest position, in use. In a second embodiment of the invention, the crown of the free end may lie above the line when the piano action is in its rest position, in use, and may move below the line when the piano action is in its check position.

The hammer shank may carry a knuckle which is engaged by the jack, a surface of the knuckle engaged by the jack lying below the first line when the piano action is in its rest position, in use, and lying above the line when the piano action is in its check position.

The receiving means may be a bore which receives the adjustment means in the form of an adjustment screw or drop screw. The drop screw, in use, limits the travel of the repetition lever of the wippen.

The hammer shank assembly may include a mounting means for mounting the knuckle, the mounting means being arranged at a distance of greater than 17 mm towards the hammer from the fourth pivot point. More particularly, the mounting means may be arranged approximately 20 mm from the pivot point for reducing pressure loading of the jack on the knuckle.

In the first embodiment of the invention, the radiussed portion of the jack tender of the jack may have a radius lying in the range from about 10 mm to 15 mm, preferably about 12 mm to 14 mm and, optimally, approximately 13.6 mm. In the second embodiment of the invention, the radiussed portion of the jack tender may have a radius lying in a range of about 10 mm to 35 mm, preferably, about 25 mm to 30 mm and, optimally, about 30 mm.

An included angle between the jack body and the jack tender may be an obtuse angle.

BRIEF DESCRIPTION OF THE DRAWING

The invention is now described by way of example with reference to the accompanying drawings in which.

DETAILED DESCRIPTION OF THE DRAWINGS

Figure 1:
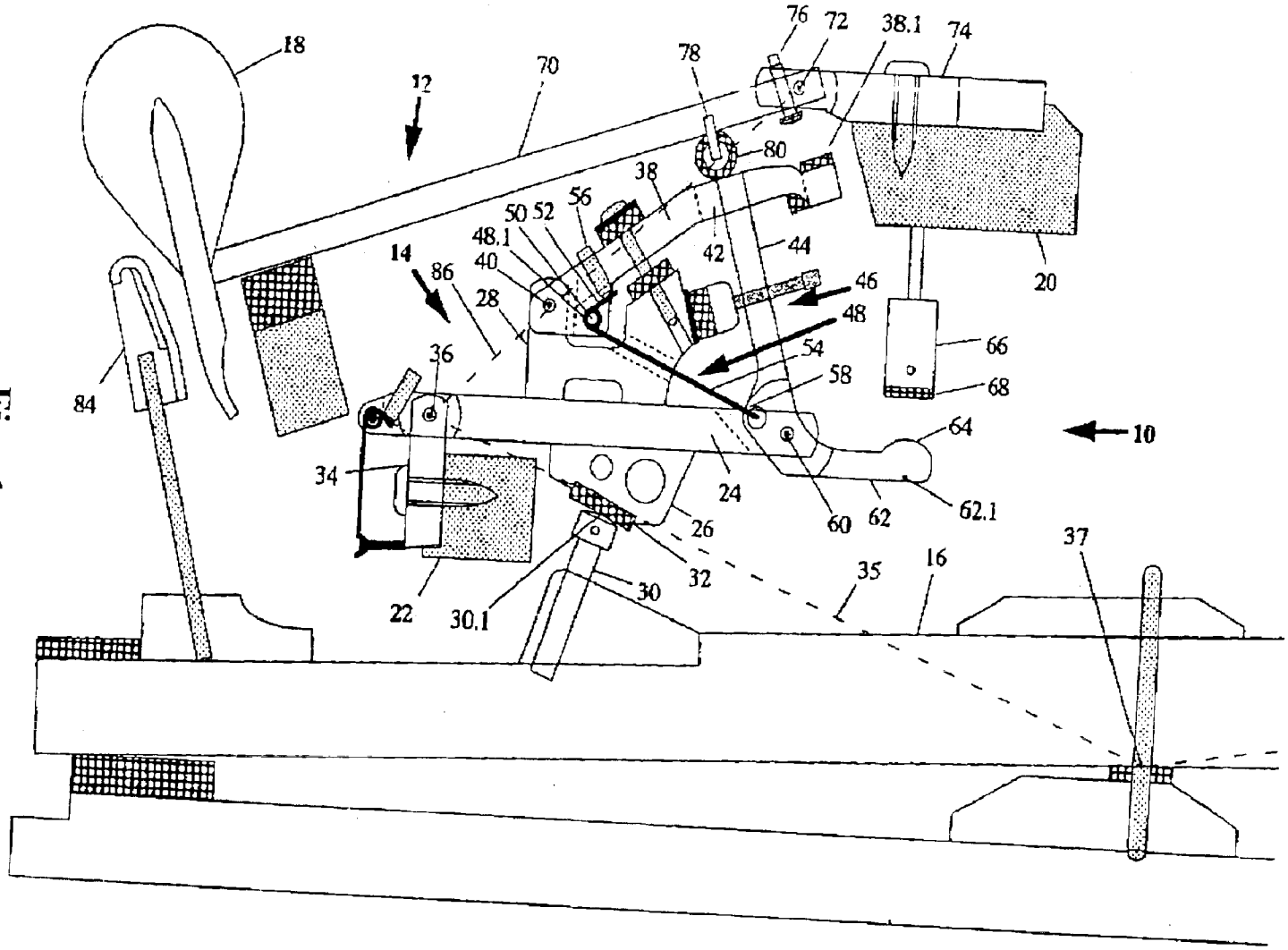
FIG. 1 shows a schematic, sectional side view of a piano action including components, in accordance with a first embodiment of the invention, in its rest position.

In the drawing, reference numeral 10 generally designates a piano action, in accordance with the invention. The piano action 10 includes a hammer shank assembly 12 which is acted on by a wippen 14 when a piano key 16 is struck to drive a hammer 18 of the hammer shank assembly 12 into transitory engagement with strings (not shown) of the piano.

In the piano, support members in the form of a hammer rail 20 and a wippen rail 22 are mounted. The hammer shank assembly 12 is mounted on the rail 20 while the wippen 14 is mounted on the rail 22.

The wippen 14 includes a wippen body 24. A wippen heel 26 depends from the wippen body 24 and a boss 28 is mounted on the wippen body 24.

Figure 2:
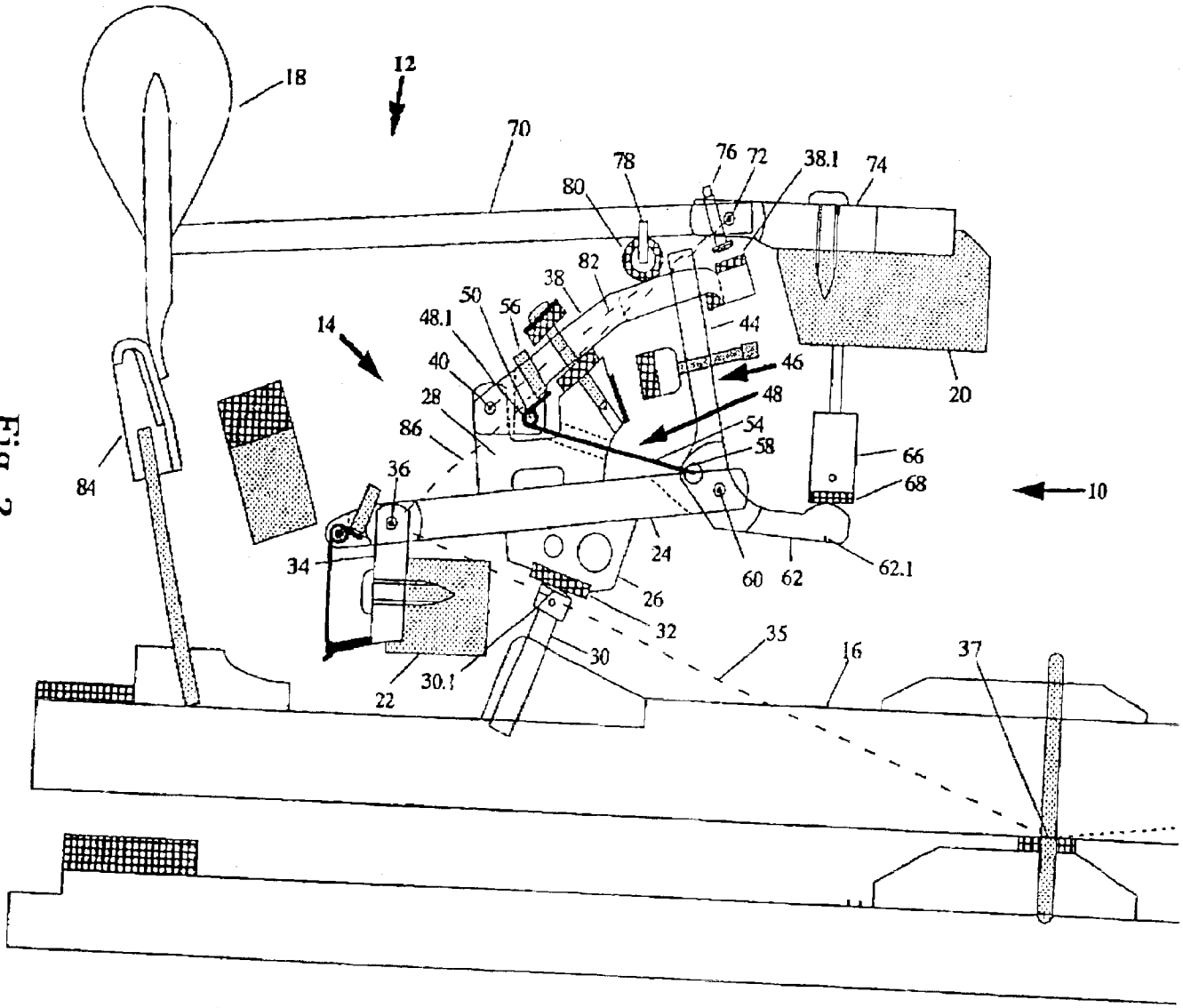
FIG. 2 shows a schematic, sectional side view of the piano action of FIG. 1 in its check position.
Figure 3:
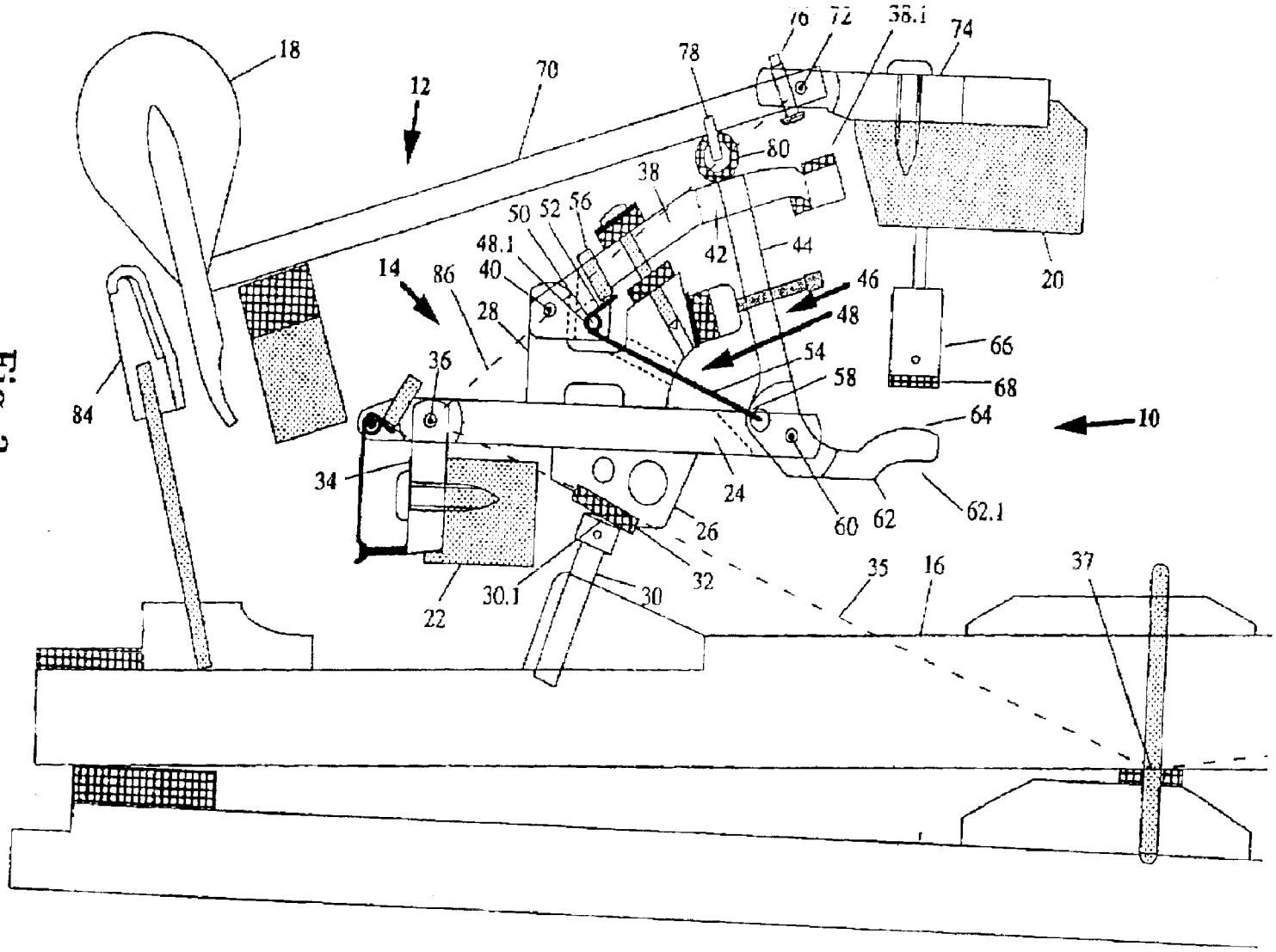
FIG. 3 shows a schematic, sectional side view of a piano action including components, in accordance with a second embodiment of the invention, in its rest position.
Figure 4:
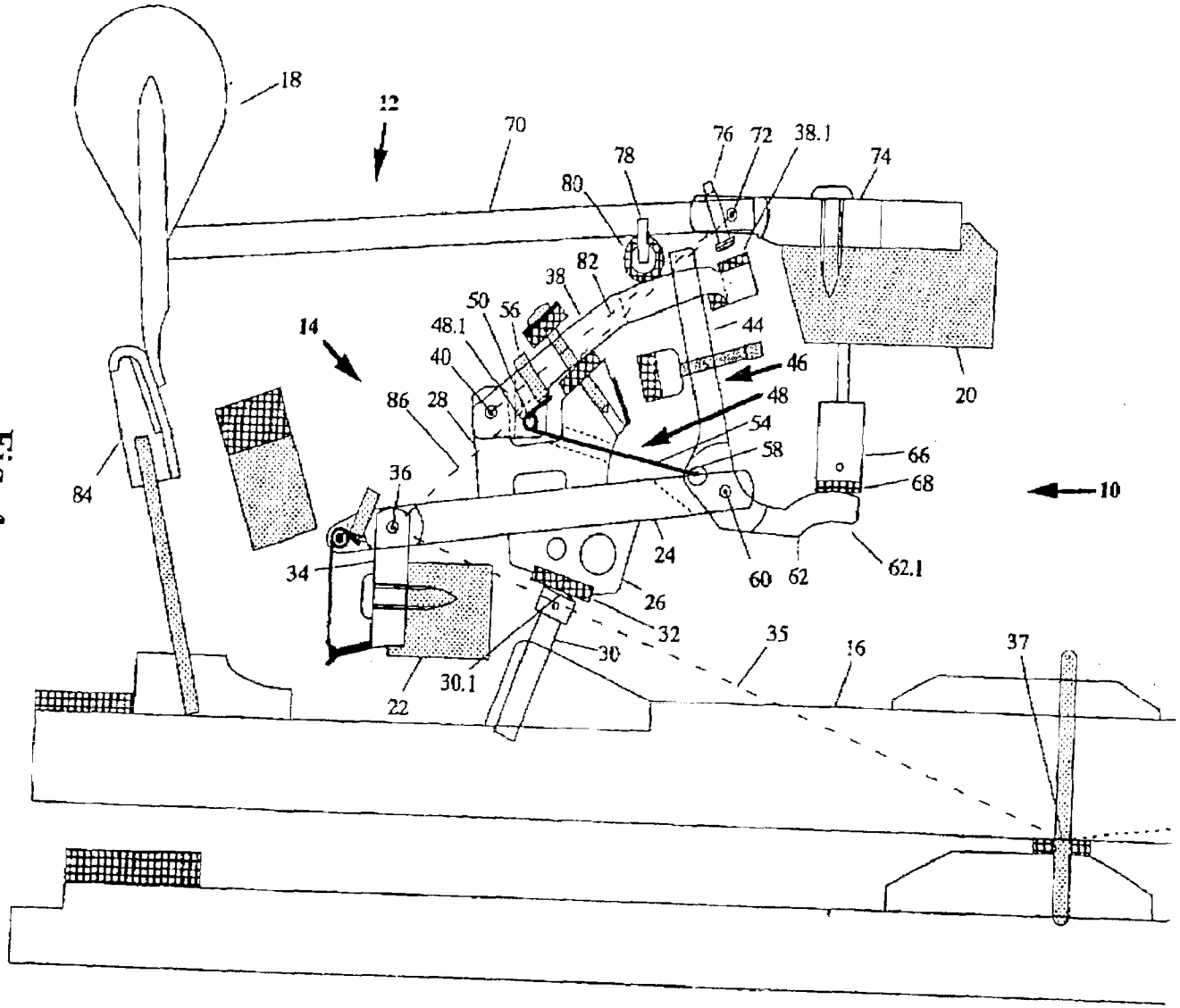
FIG. 4 shows a schematic, sectional side view of the piano action of FIG. 3 in its check position.

When the action 10 is in its rest position, as shown in FIGS. 1 and 3 of the drawings, the heel 26 bears via a heel baize 32 against a capstan 30 mounted in the piano key 16. It is to be noted that, at rest, a head 30.1 of the capstan 30 lies below an imaginary line 35 extending between a first pivot point 36 and a pivot point 37 of the piano key 16. At check, as shown in FIGS. 2 and 4, the head 30.1 of the capstan 30 lies above the imaginary line 35.

The heel 26 of the wippen 14 and the capstan 30 are arranged such that a longitudinal axis of the capstan 30 lies substantially perpendicularly to the imaginary line 35 between the pivot points 37 and 36. When the piano key. 16 is depressed to a mid-point between the rest and check positions, the face of the wippen heel baize 32 is angled to lie along the line 35. This arrangement allows for a reduction in the pressure loading between the capstan head 30.1 and the heel baize 32 with a corresponding reduction in the friction between the surfaces of the capstan head 30.1 and the baize 32 which are in contact with each other. Furthermore, the load between a back lever length of the key, ie. a second lever length of the key as measured between the pivot point 37 and a contact point of the capstan head 30.1 with the heel baize 32 and a first lever length of the wippen 14, ie. as measured between the contact point of the capstan head 30.1 with the heel baize 32 and the first pivot point 36, is directed substantially in the mean direction of the circular rotation of the levers. This allows for a further slight reduction in frictional losses since there is, in this arrangement, a reduction in the vector force directed towards the first pivot point 36.

The appropriate angle of the longitudinal axis of the capstan 30 and, accordingly, the wippen heel baize 32 inclination will vary according to the requirements of the particular action 10 installation, since the horizontal distance between the first pivot point 36 and the pivot point 37 will vary according to the installation and relative to the length of the piano. The inclination of the imaginary line 35 will also vary according to the installation. To facilitate the reduction in frictional losses, the longitudinal axis of the capstan 30 must always be set at an angle to the vertical with the wippen heel baize being arranged at right angles to the longitudinal axis of the capstan 30.

The wippen 14 is mounted on the wippen rail 22 by means of a wippen flange 34. The wippen body 24 is pivotally attached to the wippen flange 34 by means of a pivot pin which defines the first pivot point 36. It is important to note that all the pivot pins referred to in the specification are sleeved with a baize material for reducing friction and noise. A repetition lever 38 is pivotally mounted via a pivot pin at a second pivot point 40 to the boss 28 of the wippen body 24. The repetition lever has a throat 42 defined therein through which a jack body 44 of a jack 46 extends.

The repetition lever 38 is biased to its rest position by means of a repetition lever spring 48. The repetition lever spring 48 also serves to bias the jack 46 to its rest position. The repetition lever spring 48 is pivotally mounted at 50 on the repetition lever 38 and has a first limb 54 and a second limb 52. The mounting of the spring 48 on the repetition lever 38 is a departure from conventional piano actions. Further, the second limb 52 of the repetition lever spring bears against a grub screw 56 in the repetition lever 38. The limb 52 is truncated and a free end of the limb 52 is spaced front a bottom of the repetition lever 38 and does not engage the bottom of the repetition lever 38. Accordingly, when the repetition lever 38 moves relative to the wippen body 24, the limb 52 of the spring 48 moves in conjunction with the repetition lever 38 and does not slide against the repetition lever 38. In so doing, frictional losses are reduced and wear on the repetition lever 38 is also reduced. Further, as a result, the required spring tension of the spring 48 is reduced. To give the spring 48 the required spring characteristics, the spring 48 has a multi-turn coil 48.1 around the pivot 50 Preferably, the spring 48 has a three-turn coil 48.1. With this arrangement, the need for kinks or coils along the length of the first limb 54 is obviated.

The first limb 54 of the repetition lever spring 48 extends from its pivotal connection 50 and engages a mounting formation 58 of the jack 46. The jack 46 is pivotally mounted via a pivot pin at a third pivot point 60 at an end of the wippen body 24 opposite the mounting of the wippen body 24 to the wippen flange 34.

The arrangement of the repetition lever spring 48 and the jack mounting 58 is that, when in the rest condition, the limb 54 of the repetition lever spring 48, the mounting formation 58 of the jack 46 and the third pivot point 60 mounting the jack 46 to the wippen body 24 are aligned. With this arrangement frictional losses are also reduced as friction between the limb 54 of the spring 48 and the jack 46 is reduced. The reason for this is that sliding movement between the limb 54 and the jack 46 is minimised.

The jack 46 includes a jack tail or tender 62. A free end 62.1 of the tender 62 is radiussed as at 64. It is to be noted that this radius 64 is significantly greater than radii of jack tenders of conventional piano actions. In the embodiment of the invention shown in FIGS. 1 and 2 of the drawings, the radius is in the region of 10 to 15 mm, more particularly 12 to 14 mm and, optimally, 13.6 mm. The formula used to calculate the radius 64 of the jack tender 62 is:

$$R = \frac{S \times 180}{\pi \times J}$$

where

R=radius 64 of jack tender 62;

S=horizontal component of travel of free end 62.1, and

J=angular rotation of jack tender 62 during lett-off, in degrees.

A crown of the radiussed portion 64 of the jack tender 62, when the jack 46 is at rest, is aligned with the pivot points 36 and 60. As a result, an included angle between the jack body 44 and the jack tender 62 is greater than 90°.

FIGS. 3 and 4 show a second embodiment of the invention. With reference to FIGS. 1 and 2, like reference numerals refer to like parts unless otherwise specified. In this embodiment of the invention, the radiussed portion 64 of the jack tender 62, is in the region of 25 m to 35 mm and, more particularly, about 30 mm. When the piano action 10 is in its rest position, a crown of the radiussed portion 64 lies higher, or is offset, by about 1 mm to 4 mm, optimally, about 2 mm above an imaginary line passing through the pivot points 36 and 60. In this case, the offset of the radiussed portion 64 is selected to satisfy the following equation:

$$T = \frac{R \times \pi \times I}{180}$$

where

T=travel of free end 62.1 in a linear direction parallel to a face of the lett-off button 66, and R and J have their meanings given above.

A lett-off button 66 is suspended from the rail 20. When the radiussed portion 64 of the jack 46 of either embodiment abuts the lett-off button 66 during escapement, the arrangement of the jack tender 62 facilitates rotation of the jack tender 62 relative to a baize cover 68 of the lett-off button 66. In other words, slippage of the jack tender 62 relative to the lett-off button 66 is reduced thereby further reducing frictional losses and wear of the covering 68. Further, the shorter wippen body 24 and larger radius of the jack tender 62 combine to increase the movement of the jack tender 62 across the covering 68 of the lett-off button 66 during lett-off. This reduces the tendency of the covering 68 of the lett-off button 66 to compress since compression loading on the covering 68 is more distributed throughout the motion of the jack tender 62 relative to the covering 68 during lett-off.

The hammer shank assembly 12 includes a shank 70. The hammer 18 is mounted at one end of the shank 70. An opposed end of the shank 70 is pivotally mounted via a pivot pin at a fourth pivot point 72 to a hammer flange 74. The hammer flange 74 is secured to the rail 20. An adjustment means in the form of a drop screw 76, which limits the movement of the repetition lever 38, is mounted in the hater flange 74 between the pivot point 72 and the hammer 18 but close to the pivot point 72. This is unlike conventional actions where the drop screw 76 is mounted outwardly of the pivot point 72, ie. on the rail 20 side of the pivot point 72. The mounting of the drop screw 76 in this position is facilitated by increasing the spacing of a mounting 78 of a knuckle 80 relative to the pivot point 72. In conventional actions, this mounting is about 15 to 17 mm. In the case of the present invention, the mounting 78 is spaced about 20 mm from the pivot point 72.

While this new setting increases the rotational speed of the wippen 14 by a predetermined amount with respect to the hammer shank 12, it reduces the pressure loading of the jack 46 on the knuckle 80 by a corresponding amount. This, together with the diameter of the knuckle 80 and a length of the wippen body 24, alters the jack/knuckle contact position setting its mean position around the line of least resistance between the pivot point 36 and the pivot point 72.

At the rest position of the hammer shank assembly 12, the revised jack/knuckle contact point is approximately 3.5 mm below a line 86 passing through the pivot points 36 and 72, the line 86 being the line of least resistance. At lett-off, the contact point is about 3.5 mm above the line 86. This setting reduces frictional losses and wear between the knuckle 80 and the jack 46.

By positioning the drop screw 76 inwardly of the pivot point 72, less sliding movement between a free end 38.1 of the repetition lever 38 and the drop screw 76 occurs resulting in reduced frictional losses and wear.

Also, with this arrangement, when the hammer 18 is in its check position, as shown in FIG. 2 or 4 of the drawings, the position of the pivot point 40 of the repetition lever 38 allows for a straight line 82 through the repetition lever 38/knuckle 80 contact and the pivot point 72. This results in a minimum of frictional losses between the repetition lever 38 and the knuckle 80 as the hammer 18 rises out of check. As a consequence, the repetition lever 38 is able to lift the hammer 18 out of check at an optimum speed with reduced effort. In so doing, the spring tension for correct operation of the action 10 is reduced.

A back check 84 is provided against which the hammer 18 bears on its downward stroke.

It is an advantage of the invention that a piano action 10 is provided which has been optimised to reduce frictional losses. In so doing, the wear on the action 10 is reduced. However of equal importance is that the mechanical efficiency of the action between the key 16 and the hammer 18 is improved due to the reduction in frictional losses resulting from the improved design of the action 10.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A piano action which includes a wippen having a wippen body, the wippen body being pivotally mountable via a first end of the wippen body on a first rail of a piano, the wippen including a wippen flange for mounting the wippen relative to the first rail and the wippen body including a first pivot point for pivotally mounting it to the wippen flange;

a repetition lever pivotally mounted on the wippen body;

a jack pivotally mounted on the wippen body;

a boss arranged on the wippen body, the boss defining a second pivot point on which the repetition lever is pivotally mounted with the pivot point between the jack and the wippen body being a third pivot point, the arrangement of the pivot points being such that the first pivot point and the third pivot point are aligned along a line; and a repetition lever spring interposed between the repetition lever and the wippen body and pivotally mounted to the repetition lever, the repetition lever spring having a first limb which acts on the jack for restoring the jack to its rest position and a second limb which acts on the repetition lever for restoring the repetition lever to its rest position, the second limb being shorter than the first limb such that a free end of the second limb is out of engagement with the repetition lever and being shaped and dimensioned to move together with the repetition lever, and the first limb, when the wippen is in its rest position, in use, being substantially rectilinear along its length.

2. The piano action of claim 1 which includes a hammer shank assembly, the hammer shank assembly including a hammer shank pivotally mountable via a hammer flange to a second rail of the piano, a pivot point mounting the hammer shank to the hammer flange being a fourth pivot point.

3. The piano action of claim 1 in which the jack includes a jack tender having a radiussed free end, a crown of the free end lying substantially on the line when the piano action is in its rest position, in use.

4. The piano action of claim 1 in which the jack includes a jack tender having a radiussed free end, a crown of the free end lying above the line when the piano action is in its rest position, in use, and moving below the line when the piano action is in its check position.

5. The piano action of claim 4 in which the hammer shank carries a knuckle which is engaged by the jack, a surface of the knuckle engaged by the jack lying below the first line when the piano action is in its rest position, in use, and lying above the line when the piano action is in its check position.

6. The piano action of claim 3 in which a hammer is mounted proximate one end of the hammer shank and the fourth pivot point is arranged proximate an opposed end of the shank and pivotally mounts the shank on the hammer flange, the hammer flange, in use being secured to the second rail of the piano.

7. The piano action of claim 6 in which a receiving means is defined in the hammer flange, on a hammer side of the pivot point and adjacent the pivot point, for receiving an adjustment means.

8. The piano action of claim 7 in which the receiving means is a bore which receives the adjustment means in the form of an adjustment screw.

9. The piano action of claim 8 in which the hammer shank assembly includes a mounting means for mounting the knuckle, the mounting means being arranged at a distance of greater than 17 mm towards the hammer from the fourth pivot point.

10. The piano action of claim 3 in which the jack includes a jack body which is pivotally mountable relative to the wippen body, the jack tender extending at an angle relative to the jack body and the radiussed portion at the free end of the jack tender having a radius of at least 10 mm.

11. The piano action of claim 10 in which the radiussed portion has a radius lying in the range from about 10 mm to 15 mm.

12. The piano action of claim 11 in which the radiussed portion has a radius lying in the range of about 12 mm to 14 mm.

13. The piano action of claim 12 in which the radiussed portion has a radius of approximately 13.6 mm.

14. The piano action of claim 10 in which the radiussed portion has a radius lying in a range of about 10 mm to 35 mm.

15. The piano action of claim 14 in which the radiussed portion has a radius lying in the range of about 25 mm to 30 mm.

16. The piano action of claim 15 in which the radiussed portion has a radius of about 30 mm.

17. The piano action of claim 10 in which an included angle between the jack body and the jack tender is an obtuse angle.

18. A piano action which includes:

a wippen having a wippen body, the wippen body being pivotally mountable proximate a first end of the wippen body on a first rail of a piano;

a repetition lever pivotally mounted on the wippen body;

the jack pivotally mounted relative to the wippen body, the jack having a jack body which is pivotally mountable relative to a wippen body via a pivot point, a jack tender extending at an angle relative to the jack body, and a radiussed portion at a free end of the jack tender, the radiussed portion having a radius of at least 10 mm; and a repetition lever spring interposed between the repetition lever and the wippen body and pivotally mounted to the repetition lever, the repetition lever spring having a first limb which acts on the jack for restoring the jack to its rest position and a second limb which acts on the repetition lever for restoring the repetition lever to its rest position, the second limb being shorter than the first limb such that a free end of the second limb is out of engagement with the repetition lever and being shaped and dimensioned to move together with the repetition lever and the first limb, when the wippen is in its rest position, in use, being substantially rectilinear along its length.

19. The piano action of claim 18 in which the radiussed portion has a radius lying in the range from about 10 mm to 15 mm.

20. The piano action of claim 19 in which the radiussed portion has a radius lying in the range of about 12 mm to 14 mm.

21. The piano action of claim 20 in which the radiussed portion has a radius of approximately 13.6 mm.

22. The piano action of claim 18 in which the radiussed portion has a radius lying in a range of about 10 mm to 35 mm.

23. The piano action of claim 22 in which the radiussed portion has a radius lying in the range of about 25 mm to 30 mm.

24. The piano action of claim 23 in which the radiussed portion has a radius of about 30 mm.

25. The piano action of claim 18 in which an included angle between the jack body and the jack tender is an obtuse angle.

26. The piano action of claim 18 in which the wippen includes a wippen flange for mounting the wippen relative to the first rail.

27. The piano action of claim 26 in which the wippen body includes a first pivot point for pivotally mounting it to the wippen flange.

28. The piano action of claim 27 in which a boss is arranged on the wippen body, the boss defining a second pivot point on which the repetition lever is pivotally mounted with the pivot point between the jack and the wippen body being a third pivot point.

29. The piano action of claim 28 which includes a hammer shank assembly, the hammer shank assembly including a hammer shank pivotally mountable via a hammer flange to a second rail of the piano, a pivot point mounting the hammer shank to the hammer flange being a fourth pivot point.

30. The piano action of claim 29 in which the arrangement of the pivot points is such that the first pivot point and the third pivot point are substantially aligned along a line.

31. The piano action of claim 30 in which a crown of the radiussed free end of the jack tender lies substantially on the line when the piano action is in its rest position, in use.

32. The piano action of claim 30 in which a crown of the radiussed free end of the jack tender lies above the line when the piano action is in its rest position, in use, and moving below the line when the piano action is in its check position.

33. The piano action of claim 30 in which the hammer shank carries a knuckle which is engaged by the jack, a surface of the knuckle engaged by the jack lying below the first line when the piano action is in its rest position, in use, and lying above the line when the piano action is in its check position.

34. A piano action which includes:

a wippen having a wippen body, the wippen body being pivotally mountable proximate a first end of the wippen body on a first rail of a piano;

a repetition lever pivotally mounted on the wippen body;

a jack pivotally mounted relative to the wippen body; and a repetition lever spring interposed between the repetition lever and the wippen body and pivotally mounted to the repetition lever, the repetition lever spring having a first limb which acts on the jack for restoring the jack to its rest position and a second limb which acts on the repetition lever for restoring the repetition lever to its rest position, the second limb being shorter than the first limb such that a free end of the second limb is out of engagement with the repetition lever and being shaped and dimensioned to move together with the repetition lever and the first limb, when the wippen is in its rest position, in use, being substantially rectilinear along its length;

a hammer shank assembly including a hammer shank;

a hammer mounted proximate one end of the shank;

a pivot point arranged proximate an opposed end of the shank which pivotally mounts the shank on a hammer flange, the hammer flange being mountable on a second rail of the piano; and a receiving means defined in the hammer flange, on a hammer side of the pivot point and adjacent the pivot point, for receiving an adjustment means.

35. The piano action of claim 34 in which the receiving means is a bore which receives the adjustment means in the form of an adjustment screw.

36. The piano action of claim 34 in which the hammer shank assembly includes a knuckle and a mounting means for mounting the knuckle, the mounting means being arranged at a distance of greater than 17 mm towards the hammer from the pivot point.

37. The piano action of claim 34 in which the wippen includes a wippen flange for mounting the wippen relative to the first rail.

38. The piano action of claim 37 in which the wippen body includes a first pivot point for pivotally mounting it to the wippen flange.

39. The piano action of claim 38 in which a boss is arranged on the wippen body, the boss defining a second pivot point on which the repetition lever is pivotally mounted with the pivot point between the jack and the wippen body being a third pivot point.

40. The piano action of claim 39 in which the pivot point mounting the hammer shank to the hammer flange is a fourth pivot point.

41. The piano action of claim 40 in which the arrangement of the pivot points is such that the first pivot point and the third pivot point are substantially aligned along a line.

42. The piano action of claim 41 in which the jack includes a jack tender having a radiussed free end, a crown of the free end lying substantially on the line when the piano action is in its rest position, in use.

43. The piano action of claim 41 in which the jack includes a jack tender having a radiussed free end, a crown of the free end lying above the line when the piano action is in its rest position, in use, and moving below the line when the piano action is in its check position.

* * * * *